United States Patent [19]

Pershing et al.

[11] Patent Number: 4,485,747

[45] Date of Patent: Dec. 4, 1984

[54] REDUCING POLLUTANT EMISSIONS BY FINES REMOVAL

[75] Inventors: David W. Pershing, Salt Lake City, Utah; George B. Martin, Cary, N.C.; James M. Munro, Rapid City, S. Dak.

[73] Assignee: The United States of America as represented by the Environmental Protection Agency, Washington, D.C.

[21] Appl. No.: 514,192

[22] Filed: Jul. 15, 1983

[51] Int. Cl.[3] ..... F23D 1/00

[52] U.S. Cl. ..... 110/347; 110/115; 110/220; 110/263

[58] Field of Search ..... 110/347, 232, 115, 263, 110/245, 220, 346

[56] References Cited

U.S. PATENT DOCUMENTS

| | | | |
|---|---|---|---|
| 2,794,406 | 6/1957 | Stark | 110/115 X |
| 4,155,313 | 5/1979 | Moss | 110/347 X |
| 4,235,174 | 11/1980 | Spurrell | 110/220 X |
| 4,249,470 | 2/1981 | Vatsky | 110/232 |
| 4,397,248 | 8/1983 | Mehta et al. | 110/347 X |

OTHER PUBLICATIONS

"Steam-Chapter 11: Stokers", 39th Ed., Babcock & Wilcox, New York, New York (1982).

K. L. Maloney et al., "Combustion Modification for Coal-Fired Stoker Boilers," Proceedings of the Joint Symposium on Stationary Combustion $NO_x$ Control (vol. III) 83-98 (Oct. 1980).

R. D. Giammar et al., "Evaluation of Emissions and Control Technology for Industrial Stoker Boilers," Proceedings of the Joint Symposium on Stationary Combustion $NO_x$ Control (vol. III) 1-38 (Oct. 1980).

*Primary Examiner*—Edward G. Favors

*Attorney, Agent, or Firm*—H. Ross Workman; Allen R. Jensen; Dale E. Hulse

[57] ABSTRACT

A method and apparatus for reducing pollutant emissions, and in particular, for reducing $NO_x$ and particulate emissions, from a spreader-stoker-fired furnace and from a fluidized bed combustor. A combustible material of various sized particles is obtained and those smaller particles which would normally combust during the suspension phase of the spreader-stoker-fired furnace or fluidized bed combustor are separated from the larger particles. The larger particles of combustible material are then introduced into the spreader-stoker-fired furnace or fluidized bed combustor and combusted to produce heat.

38 Claims, 7 Drawing Figures

| | | | | |
|---|---|---|---|---|
| Stoichiometric Ratio At Bed Region | 1.2 | 1.4 | 1.2 | 1.2 |
| Excess $O_2$ (%) | 6.8 | 8.9 | 6.7 | 6.7 |
| Load (Btu/hr x $10^{-3}$) | 470 | 470 | 560 | 470 |

REDUCING POLLUTANT EMISSIONS BY FINES REMOVAL

GOVERNMENT RIGHTS

The present invention was developed at least in part pursuant to support received from the United States Environmental Protection Agency through cooperative agreements CR 805899 and CR 809267, and the Government of the United States of America has certain rights under those cooperative agreements.

BACKGROUND

1. Field of the Invention

The present invention relates to pollution control methods and apparatus, and in particular to methods and apparatus for reducing pollutant emissions from spreader-stoker-fired furnaces and fluidized bed combustors by removing fines from the material to be combusted.

2. The Prior Art

For centuries, man has relied upon the combustion of combustible materials, such as coal and wood, to provide heat energy. One of the most common methods for harnessing this heat energy is to use the heat energy to generate steam. Over the years, different types of furnaces or boilers have been developed for the combustion of coal, wood, and other combustible materials.

One type of furnace, the stoker-fired furnace, was developed to burn relatively large particles of coal, up to about 1.5 inches in diameter. Later, another type of furnace, the pulverized coal-fired furnace, was developed for burning much smaller coal particles, e.g., where about 70% of the coal particles pass through a 200 mesh screen. Pulverized coal-fired furnaces have large steam generating capacities and are thus typically used in steam generating installations where at least 500,000 pounds of steam per hour are required. The electric power generating industry has been one of the largest users of pulverized coal-fired furnaces, since large amounts of steam are required for the production of electric energy.

Because of the small particle sizes of coal which are used in the pulverized coal-fired furnaces, expensive pulverizing steps are necessarily employed to reduce the particle size of the coal. Moreover, pulverized coal-fired furnaces involve extensive capital outlays. As a result, whenever practical, those skilled in the art prefer to use stoker-fired furnaces. Stoker-fired furnaces have especially found utility in smaller operations where the steam generating capacity of the stoker-fired furnace is sufficient to meet the needs of the operation.

In the late 1940's and early 1950's, there was a large decline in the demand for commercial and industrial solid fuel-fired systems (such as the stoker-fired and pulverized coal-fired systems) due to the wide-spread availability of relatively cheap oil and natural gas sources. In the 1960's, the stoker-fired and pulverized coal-fired systems became even less attractive because of their relatively high pollutant emissions when compared with the oil and gas-fired systems. Thus, the oil and gas-fired systems substantially replaced the coal-fired systems until the gas and oil petroleum-based fuels became less plentiful during the 1970's. The petroleum shortage experienced during the 1970's has caused industry to begin to look once again to the coal-fired and other solid fuel-fired systems.

In recent years, considerable emphasis has been given to solid fuel research, particularly in the area of burning solid fuels such as coal and wood without excessive pollutant emissions. As the costs of oil and gas continue to escalate, the utilization of solid fuel systems (such as coal-fired systems) will continue to increase. In particular, the use of stoker-fired systems is increasing due to the substantial savings involved when the larger coal particles are introduced into the furnace without expensive pulverizing steps as are necessary for the pulverized coal-fired processes.

One type of stoker-fired furnace, and undoubtedly the most popular type, is the spreader-stoker-fired furnace. The spreader-stoker-fired furnace is characterized in that it has a paddle wheel-type mechanism or air jet for flinging the coal particles into the furnace such that the coal particles are suspended in and travel through a suspension or overthrow region within the furnace for an appreciable period of time before falling onto a grate located at the bottom of the furnace. This suspension of the coal particles within the suspension region of the spreader-stoker-fired furnace is commonly referred to as the "suspension phase." In typical spreader-stoker-fired furnace systems, a portion of the coal is combusted in the suspension phase, before reaching the grate. Coal particles which are not burnt during their descent in the suspension phase, come to rest against the grate and form a burning fuel bed in a bed region of the furnace. Other coal particles are entrained by the flow of gases within the furnace and are not combusted in either the suspension or bed regions, but rather escape uncombusted in the furnace effluent. The grate on which the burning fuel bed resides moves at a very slow rate, e.g., from about 5 to 40 feet per hour, and eventually dumps the combustion by-products (namely, residual ash) into an ash pit. Alternatively, the grate may be stationary but have the capability of being dumped at periodic intervals to remove the bed of accumulated ash.

One reason for the popularity of the spreader-stoker-fired furnace is its high superficial grate heat release rates of up to 750,000 BTU/hr-ft$^2$ and its low inertia due to nearly instantaneous fuel ignition upon increased firing rate. This high superficial grate heat release is obtained because of the relatively uniform distribution of the coal particles in the burning fuel bed on the grate, the relatively small depth of the layer of coal particles on the grate, and the intense combustion during the suspension phase above the burning fuel bed. The low inertia allows the spreader-stoker-fired furnace to respond rapidly to load fluctuations in steam demand, and hence in boiler load, which are common in industrial applications.

In addition, spreader-stoker-fired furnaces are capable of firing fuels with a wide range of burning characteristics, including coals with caking tendencies, since rapid surface heating of the coal in the suspension phase destroys the caking propensity. Additionally, little or no fuel preparation is required for spreader-stoker firing of coal; if needed, the coal can be crushed to particle sizes of about 1.5 inches or less in diameter and directly fired. In other types of stoker-fired furnaces, the coal particles are typically introduced directly onto the burning fuel bed at the bottom of the furnace without experiencing a suspension phase.

During the combustion of solid fuels (such as coal), nitrogen which is bound primarily in heterocyclic ring structures is liberated as CN fragments which subsequently react to form nitrogen gas ($N_2$) or nitrogen oxide pollutants. The nitrogen oxide pollutants, generally designated $NO_x$, are primarily in the form of nitric oxide (NO) and nitrogen dioxide ($NO_2$). While the nitrogen gas emissions are relatively harmless, the $NO_x$ emissions are highly toxic. Nitrogen dioxide is an especially dangerous pollutant since $NO_2$ as well as other pollutants such as $SO_2$ and $SO_3$, are often responsible for what is known as acid rain. Even if the $NO_x$ emissions are in the form of NO, which is the favored nitrogen oxide formed in most combustion processes, NO is readily oxidized in the atmosphere to $NO_2$.

Although spreader-stoker-fired furnaces have been thought to be more efficient than other stoker-fired furnaces due to improved exposure of coal particles to oxygen during the suspension phase, excessive $NO_x$ emissions from spreader-stoker-fired furnaces have been experienced. These undesirable $NO_x$ emissions may exceed currently proposed governmental standards, and therefore may tend to discourage the use of spreader-stoker-fired furnaces.

Other pollutant emissions characteristic of spreader-stoker-fired furnaces include particulate emissions. Particulate emissions become a particular problem in spreader-stoker-fired furnaces since the solid fuel or coal particles are suspended for an appreciable period of time during the suspension phase where they are contacted by the rising flow of combustion gases and a relatively forceful stream of air. Such contact between the particles and the flow of gases during the suspension phase increases the amount of coal, ash, and other particulates which are entrained in the furnace effluent.

In view of the wide-spread popularity of the spreader-stoker-fired furnace for the combustion of coal, wood, and other combustible materials, it would be a significant advancement in the art to provide a method and apparatus for reducing pollutant emissions, and in particular for reducing $NO_x$ and particulate emissions, from such spreader-stoker-fired systems. Such a method and apparatus are disclosed and claimed herein.

BRIEF SUMMARY AND OBJECTS OF THE INVENTION

The present invention relates to a method and apparatus for reducing pollutant emissions, and in particular for reducing $NO_x$ and particulate emissions, from a spreader-stoker-fired furnace or from a fluidized bed combustor. For convenience herein, the present invention will be described primarily in terms of its application to a spreader-stoker-fired furnace; however it will be understood that the present invention also relates to other combustion apparatus wherein the combustible material passes through a suspension phase, such as a fluidized bed combustor. According to the present invention, a quantity of combustible material is obtained and, if necessary, is comminuted. The smaller particles of combustible material which would normally combust during the suspension phase of the spreader-stoker-fired furnace are separated out from the remaining larger particles of combustible material, and the larger particles are introduced into the spreader-stoker-fired furnace where they are combusted to produce heat for the production of steam or other purposes. The separated smaller particles of combustible material, or fines, can be used in a pulverized coal-fired furnace, burned in a low $NO_x$ fines burner, or placed directly onto the burning fuel bed of a spreader-stoker-fired furnace for combustion thereof.

By removing the smaller particles of combustible material or fines before introducing the larger particles of combustible material into the spreader-stoker-fired furnace, the relatively high $NO_x$ pollutant emissions which are evolved during the suspension phase can be substantially reduced. Moreover, the particulate emissions which would otherwise result from suspended fines being entrained in the flow of gases through the suspension region of the furnace are avoided, since the fines are removed and only the larger particles of combustible material are introduced into the suspension region of the spreader-stoker-fired furnace.

It is, therefore, an object of the present invention to provide methods and apparatus for reducing pollutant emissions, such as $NO_x$ emissions, from a spreader-stoker-fired furnace and from a fluidized bed combustor.

Another object of the present invention is to provide methods and apparatus for reducing pollutant emissions, such as particulate emissions, from a spreader-stoker-fired furnace and from a fluidized bed combustor.

A further object of the present invention is to provide improved methods and apparatus for the combustion of combustible materials such as coal and wood.

These and other objects and features of the present invention will become more fully apparent from the following description and appended claims, taken in conjunction with the accompanying drawings.

DETAILED DESCRIPTION OF THE PREFERRED EMBODIMENTS

Figure 1:
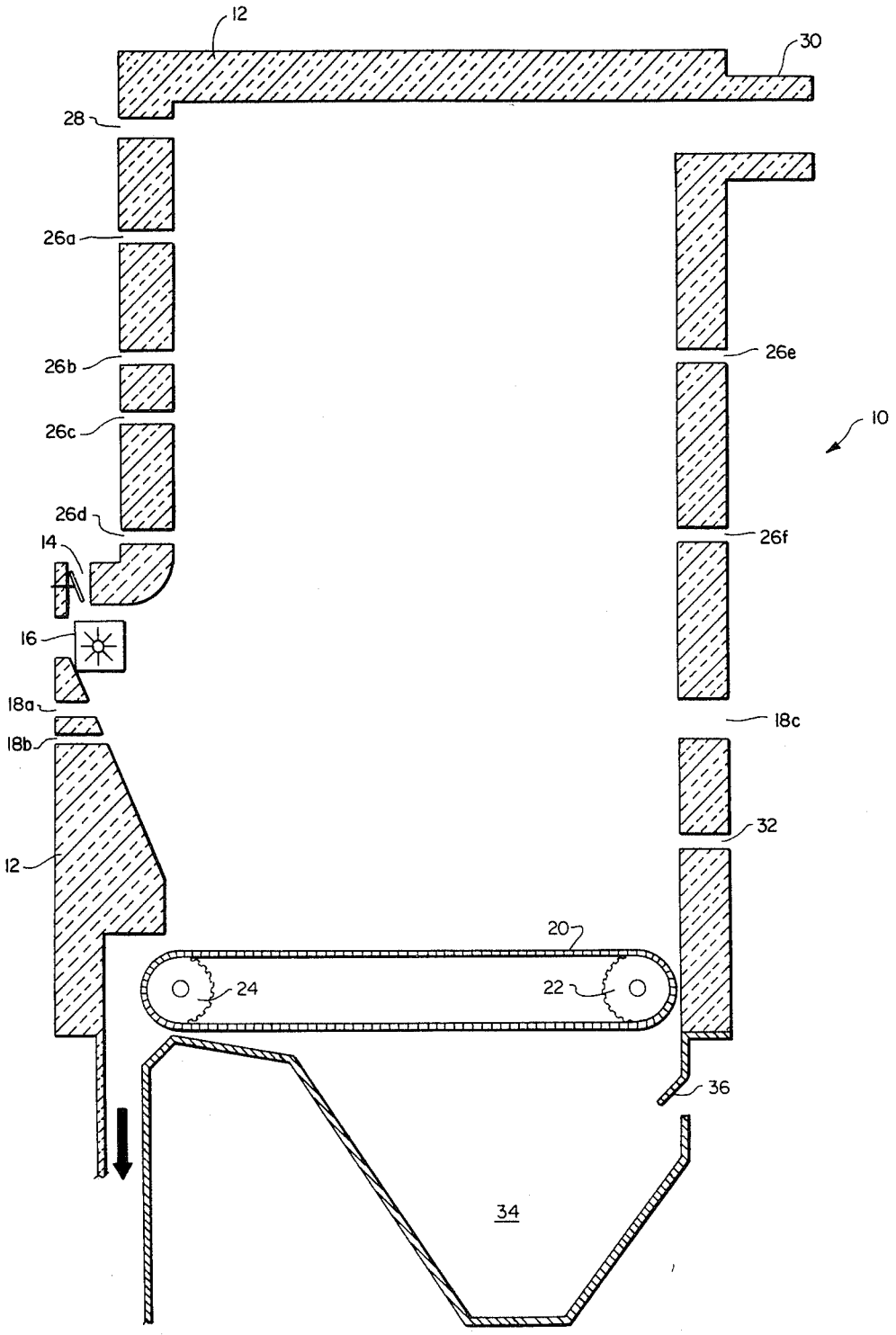
FIG. 1 is a schematical illustration of a typical spreader-stoker-fired furnace which may be used in accordance with the present invention.

For the sake of brevity, the following discussion is given in terms of an apparatus and method using coal; nevertheless, it will be readily appreciated that the following detailed description of the invention also applies to any other combustible material (e.g., wood, peat, char, and municipal, industrial, and agricultural wastes) which may be burned in a spreader-stoker-fired furnace or in a fluidized bed combustor.

A. General Discussion

Spreader-stoker-fired furnace processes have been thought to be much more efficient than other stoker-fired furnaces due to the improved exposure of the coal particles to oxygen during the suspension phase. In a typical spreader-stoker-fired furnace, about eighty-five percent (85%) of the air or oxygen introduced into the furnace is introduced through the grate and burning fuel bed at the bottom of the furnace (commonly referred to as "underfire air"). The remaining 15% of the air is introduced through a series of air jets typically located at about 18 and 72 inches above the furnace bed (commonly referred to as "overfire air").

In the prior art, it was thought that about forty to sixty percent (40–60%) of the coal particles were burned during the suspension phase. Recently, however, applicants have discovered that, in actuality, only about ten percent (10%) of the coal particles are combusted during the suspension phase.

While only about ten percent (10%) of the coal is burned in the suspension region of a spreader-stoker-fired furnace, applicants have further discovered that about thirty percent (30%) of the total $NO_x$ pollutants produced in the spreader-stoker-fired furnace systems are produced during the suspension phase. Thus, although the spreader-stoker-fired furnace method for combusting coal provides good exposure of the coal particles to oxygen during the suspension phase, applicants have discovered that this creates the problem of an unduly large amount of $NO_x$ pollutants which are emitted during this suspension phase. The large quantities of $NO_x$ formed during the suspension phase thus contribute significantly to the problem of overall $NO_x$ emissions from a typical spreader-stoker-fired furnace.

In view of the foregoing, applicants have recognized that coal fines are, in large part, responsible for the inordinate amount of $NO_x$ emissions produced during the suspension phase. Thus, it has been discovered that the $NO_x$ emissions produced during the suspension phase, as well as particulate emissions, may be significantly reduced by removing the fines which would normally be expected to combust during the suspension phase. Surprisingly, this may be done without significantly impairing the efficiency of the spreader-stoker-fired furnace, since only about ten percent (10%) of the coal particles without fines removed are normally combusted during the suspension phase. However, the inordinate amount of $NO_x$ emissions (about 30%) produced during the suspension phase is significantly reduced by removing the fines.

Figure 5:
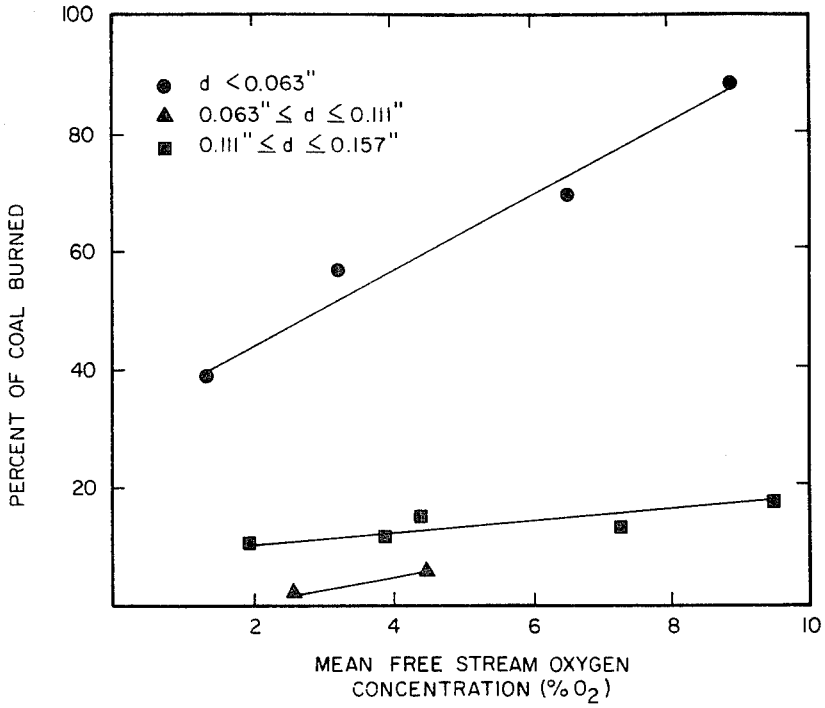
FIG. 5 is a graph showing the percent of coal burned in the suspension region of an entrained flow furnace for experiments employing different particle sizes of coal.

The novel apparatus and method of the present invention which provide for separation of the coal fines from the coal feed before introduction of the coal feed into the spreader-stoker-fired furnace yield advantageous results in terms of the reduction of pollutant emissions from the furnace. For example, removal of the fines from the coal feed results in substantially lower $NO_x$ emissions. Experimental studies have shown that most coal particles smaller than about 0.06 inches in diameter are combusted during the suspension phase within the spreader-stoker-fired furnace. FIG. 5 illustrates the results of these experimental studies.

In these experiments, coal particles having a size of about 0.111–0.157 inches, 0.063–0.111 inches, and less than 0.063 inches in diameter, were combusted in an entrained flow furnace, and the percent of each coal sample which burned in the suspension phase of the furnace was measured. The amount of coal burned in the suspension phase versus the mean free system oxygen concentration is plotted in FIG. 5 by boxes triangles, and circles, respectively.

As seen in FIG. 5, with a mean free stream oxygen concentration of about 9%, about 90% of the coal particles smaller than about 0.063 inches in diameter were combusted during the suspension phase, whereas less than 20% of the coal particles having a diameter of about 0.111–0.157 inches were combusted under the same conditions in the suspension phase. Thus, it would follow by analogy that most of the combustion occurring in the suspension region of a spreader-stoker-fired furnace is accountable to particles sizes of about 0.06 inches or less in diameter. By eliminating these fines, the amount of combustion, and thereby the amount of $NO_x$ pollutants emitted during the suspension phase, is reduced. Since it has been shown that combustion of coal particles within the suspension region results in greater $NO_x$ emissions than combusting the same coal particles in the burning fuel bed, by removing the fines and reducing the amount of combustion occurring in the suspension region of the furnace, the total amount of $NO_x$ emissions are correspondingly reduced.

Further experiments were conducted in which the total $NO_x$ emissions from a model spreader-stoker-fired furnace were measured for various particle size distributions ("PSD"): PSD-1: 23% of the particles less than 0.185 inches, 16.5% of the particles less than 0.093 inches, and 5.6% of the particles less than 0.023 inches; PSD-2: 19.5% of the particles less than 0.185 inches, 7.4% of the particle less than 0.093 inches, and 0.2% of the particles less than 0.023 inches; and PSD-3: 7.4% of the particles less than 0.185 inches, 1.2% of the particles less than 0.093 inches, and 0.2% of the particles less than 0.023 inches.

Figure 6:
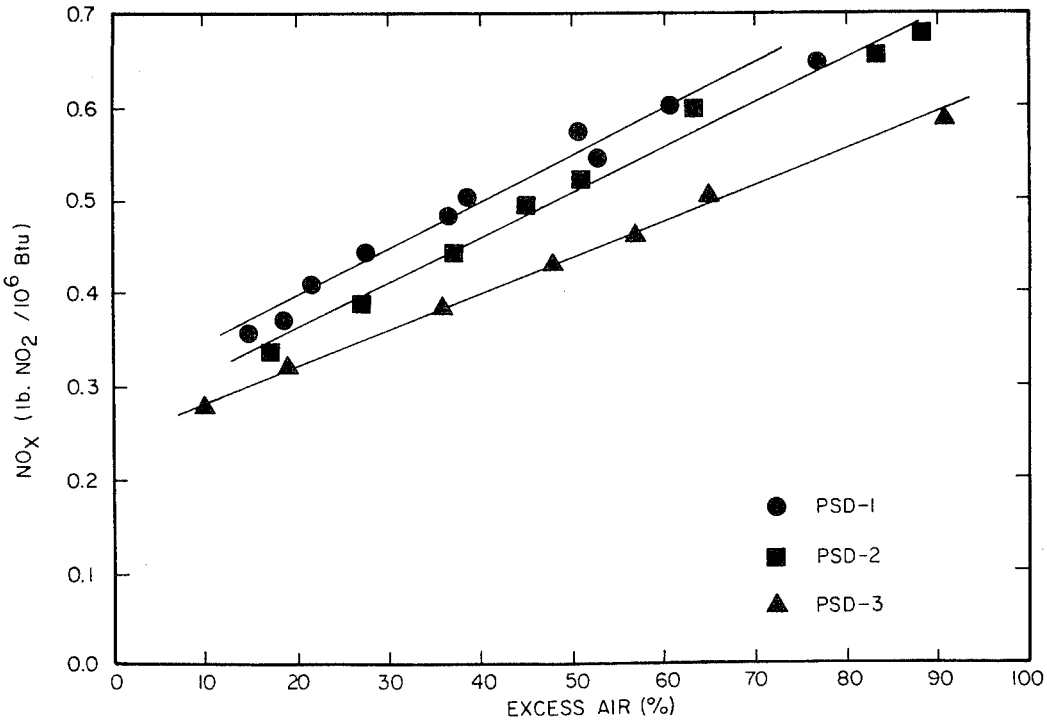
FIG. 6 is a graph showing the effects of the particle size of the combustible material on the amount of $NO_x$ emissions produced in the suspension region of a model spreader-stoker-fired furnace.

Various quantities of air in excess of the amount needed to stoichiometrically combust the coal particles were injected into the furnace in a series of experiments. The results of these experiments are tabulated in FIG. 6. As seen in FIG. 6, the amount of $NO_x$ emissions was substantially reduced for the coal particles having PSD-3 wherein substantially most of the fines had been removed, over the coal particles having PSD-1 wherein the fines had not been removed.

Experimental studies have also shown that by removing coal fines from the coal feed before introducing the coal feed into the spreader-stoker-fired furnace, particulate and unburned carbon emissions in the furnace effluent are also reduced. Since smaller coal particles have a much greater tendency to be entrained in the upward flow of gases moving through the spreader-stoker-fired furnace than do larger coal particles, removal of the coal fines results in fewer particulates and unburned carbon entrained in the upward flow of gases through the furnace, and correspondingly, fewer particulate and unburned carbon emissions from the furnace effluent.

Figure 7:
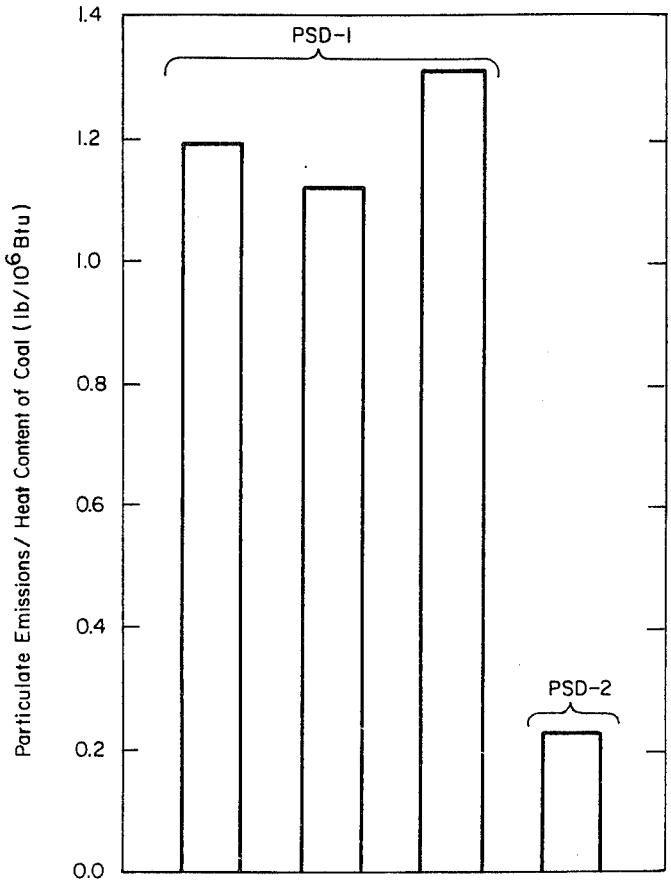
FIG. 7 is a bar graph showing the effects of the particle size of the combustible material on the amount of particulate and unburned carbon emissions produced in the suspension region of a model spreader-stoker-fired furnace.

In these experimental studies, the particulate and unburned carbon emissions from a model spreader-stoker-fired furnace were measured for two particle size distributions ("PSD"): PSD-1: 23% of the particles less than 0.185 inches, 16.5% of the particles less than 0.093 inches, and 5.6% of the particles less than 0.023 inches;

and PSD-2: 7.4% of the particles less than 0.185 inches, 1.2% of the particles less than 0.093 inches, and 0.2% of the particles less than 0.023 inches. The particulate and unburned carbon emissions for various combustion conditions were measured, and the results of the experiments are tabulated in FIG. 7. As seen in FIG. 7, the amount of particulate and unburned carbon emissions was substantially reduced for the coal particles having PSD-2 wherein substantially most of the fines had been removed, over the coal particles having PSD-1 wherein the fines had not been removed.

Thus, the novel apparatus and method of the present invention serve to reduce $NO_x$, particulate, and unburned carbon emissions from a spreader-stoker-fired furnace. Because particulate and unburned carbon losses from the spreader-stoker-fired furnace are reduced, the present invention also provides increased energy efficiency.

Moreover, it is believed that by removing the coal fines in accordance with the present invention, a significant amount of the sulfur bearing portions of the coal and a significant amount of the ash are removed from the coal. Hence, the amount of sulfur pollutants produced upon combustion of the larger coal particles would be correspondingly descreased and ash interference with the furnace performance would be correspondingly reduced.

B. The Apparatus of the Present Invention

Reference is now made to the drawings wherein like parts are designated with like numerals throughout. Referring particularly to FIG. 1, a presently preferred embodiment of a spreader-stoker-fired furnace is generally designated 10. The apparatus includes a housing 12 made of high temperature refractory or insulating material. Such refractory and insulating materials are well-known in the art and are fabricated to withstand the hot furnace temperatures which may reach as high as about 1900° C. Typically, a plurality of boiler tubes (not shown) through which water is circulated are mounted adjacent housing 12 when the furnace 10 is used for the generation of steam or hot water. In such a furnace, the water within the boiler tubes is converted to steam or hot water as the furnace is heated by combustion of the combustible material therein.

Formed in spreader-stoker-fired furnace 10 is a coal feed port 14 for introducing coal into furnace 10. A rotating paddle wheel-type spreading mechanism 16 is mounted within furnace 10 adjacent coal feed port 14 and serves to fling the incoming coal into the interior of furnace 10. Alternatively, other spreading means such as an air jet (not shown) may be used in lieu of spreading mechanism 16 to fling the coal into the furnace.

Formed at the bottom of spreader-stoker-fired furnace 10 is a moving chain grate 20 which supports a burning fuel bed inside furnace 10 during the operation thereof. Moving grate 20 rotates around two rotating drive wheels 22 and 24 which are powered by any conventional means. The speed of moving grate 20 can be regulated such that the grate moves between about 5 and about 40 feet per hour. As grate 20 advances, it serves to dump residual ashes formed during combustion into an ash pit (not shown) in the direction of the arrow shown in FIG. 1. A bed sampling port 32 is optionally provided in housing 12 of furnace 10 so as to provide a means for removing samples from the burning fuel bed on grate 20.

An air source (not shown) supplies air to an air chamber 34 through a blast gate 36. From air chamber 34, the air passes through grate 20 and into furnace 10. Additionally, overfire air ports 18*a–c* are formed in housing 12 and provide additional sites for introducing air into furnace 10 from an air source (not shown). Moreover, a second series of overfire air ports 26*a–f* are provided above paddle wheel 16 to provide further sites for introducing air into furnace 10 from an air source (not shown).

A flue 30 is provided at the upper end of furnace 10 to accommodate exit of the effluent gases from furnace 10 and into, for example, the convective passages of a boiler (not shown). A flue gas sampling port 28 may also be optionally provided in housing 12 so as to provide a means for sampling the effluent gases from furnace 10.

The apparatus of the present invention includes means for separating out smaller coal particles or fines, i.e., coal particles which would normally combust during the suspension phase of the spreader-stoker-fired furnace. For coal, this entails separating out the particles smaller than about 0.05 inches in diameter from the larger remaining coal particles. Generally, most all coal particles smaller than about 0.05 inches in diameter will combust during the suspension phase of most spreader-stoker-fired furnaces. Moreover, many coal particles having a diameter from about 0.05 inches to about 0.1 inches will also combust in the suspension region of most furnaces. Thus, one presently preferred embodiment of the present invention in its application to coal involves separating out all coal particles or fines smaller than about 0.1 inches in diameter.

It will be recognized that the foregoing particle sizes for those particles to be separated out relate specifically to coal as the combustible material employed. When other combustible materials are used, the particle sizes which would normally combust during the suspension phase and which should therefore be separated out will vary according to the particular combustible material employed.

Figure 2:
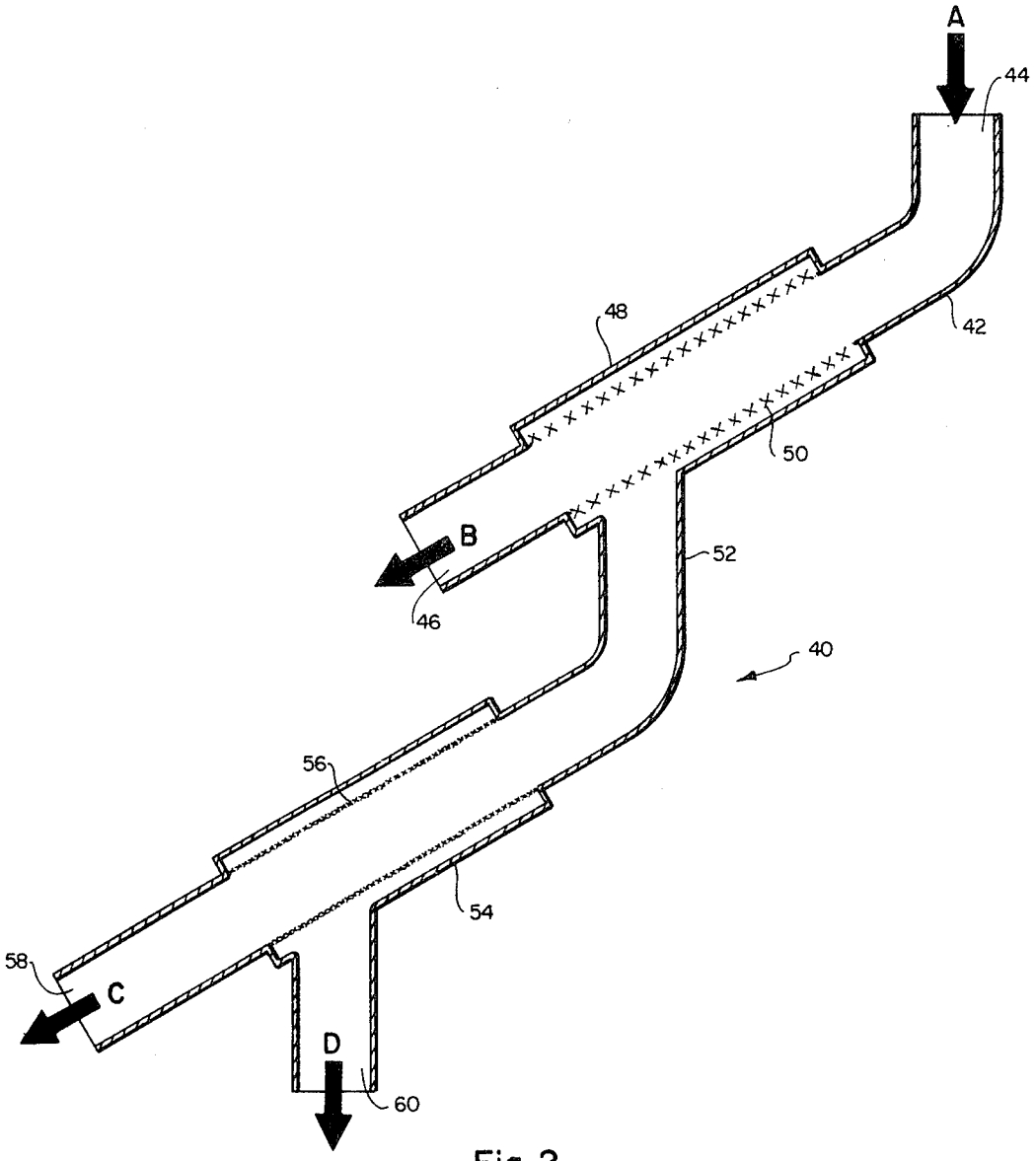
FIG. 2 illustrates one preferred embodiment of the present invention wherein the smaller particles of combustible material or fines are separated from the larger particles of combustible material, prior to introduction of the larger particles of combustible material into the spreader-stoker-fired furnace or fluidized bed combustor.
Figure 3:
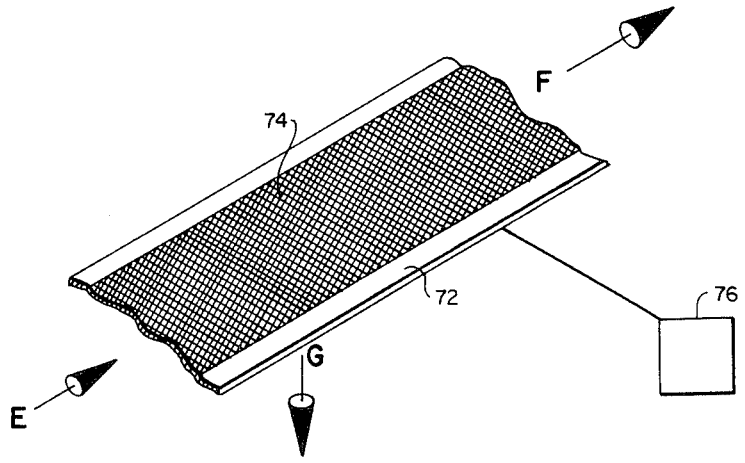
FIG. 3 illustrates a second preferred embodiment for separating the smaller particles of combustible material or fines from the larger particles of combustible material, prior to introduction of the larger particles of combustible material into the spreader-stoker-fired furnace or fluidized bed combustor.

Two presently preferred embodiments for accomplishing separation of the smaller particles from the larger particles are illustrated in FIGS. 2 and 3. In FIG. 2, a first presently preferred embodiment of the means for separating out the smaller coal particles or fines in accordance with the present invention is generally designated 40. This embodiment not only includes means for separating out the smaller coal particles, but also means for separating out coal particles larger than about 1.5 inches in diameter in the event that the starting coal contains such large particle sizes.

Coal particles larger than about 1.5 inches in diameter tend to jam up the apparatus and are difficult to handle. Thus, it will be recognized that the 1.5 inch limit is given by way of example for operating convenience only, and that larger coal particle sizes could be used if the apparatus were adapted to handle such larger particles. Moreover, it will be recognized that when combustible materials other than coal are used, the upper size limit of particles to be combusted within the spreader-stoker-fired furnace will vary according to the ability of the furnace to handle such materials. The most important parameter to control in the present invention is not the upper size limit of the particles to be combusted, but rather the lower size limit which is controlled by removing the fines. Indeed, it is the fines removal which results in the reduced $NO_x$ and particulate emissions achieved by the present invention.

Referring again to FIG. 2, separating means 40 includes an inlet 44 for accommodating entry of the coal particles to be separated (in the direction of arrow A), an outlet 46 to accommodate exit of the coal particles larger than about 1.5 inches in diameter (in the direction of arrow B), and a conduit 52 for receiving those coal particles of about 1.5 inches or smaller in diameter. A separating chamber 48 is in communication with conduit 42 and houses a screen 50 which is configurated so as to permit passage of coal particles of about 1.5 inches or smaller in diameter therethrough, while preventing passage of coal particles larger than about 1.5 inches in diameter.

To achieve such a size separation, screen 50 is constructed of a wire grid with openings of about 1.5 inches. Alternatively, it will be appreciated that screen 50 may be configurated so as to only allow passage of coal particles of about one inch or less in diameter. This will allow for easier handling of the coal particles, but must also be weighed against the economics of separating out a greater quantity of large coal particles and the subsequent uses to which the larger separated coal particles may be put.

Conduit 52 provides communication between first separating chamber 48 and a second separating chamber 54. A second screen 56 is mounted within second separating chamber 54 and is configurated so as to allow passage of coal particles smaller than about 0.05 inches in diameter therethrough, while preventing passage of coal particles of about 0.05 inches or larger in diameter. To achieve such a size separation, screen 56 is preferably constructed of a No. 14 mesh steel screen having a mesh size of about 0.055 inches. Alternatively, it will be appreciated that screen 56 may be configurated so as to permit passage of coal particles smaller than about 0.1 inches in diameter therethrough, while preventing passage of coal particles of about 0.1 inches or larger in diameter.

An outlet 58 is formed in conduit 52 to accommodate exit of the larger coal particles (in the direction of arrow C) from separating chamber 54, while a conduit 60 in communication with second separating chamber 54 provides for exit of the smaller coal particles (in the direction of arrow D). The larger coal particles removed from outlet 58 are then introduced into a spreader-stoker-fired furnace, while the smaller coal particles may be put to other uses as will be discussed in more detail hereinafter.

A second presently preferred embodiment of the means for separating out the smaller coal particles, generally designated 70, is illustrated in FIG. 3. Separating means 70 includes a conveyor belt 72 upon which is mounted the screen 74. A conventional vibrator, schematically depicted at 76, is connected to screen 74 and is capable of imparting a vibrating motion to the screen 74. Vibrator 76 may be any conventional vibrating means; for example, an FMC Syntrom magnetic vibrator available from FMC Corporation, Chicago, Ill. 60601 has been found to be suitable. As there are many types of vibrators well known in the art, it will be understood that any suitable means for vibrating screen 74 may be employed with the present invention.

It will also be appreciated that variations of the embodiments of the separating means illustrated in FIGS. 2 and 3 are possible. For example, if the coal particles in the starting material are already small enough (e.g., about 1.5 inches or less in diameter) the first screening procedure of the embodiment in FIG. 2, wherein the coal particles are passed through screen 50, could be completely eliminated, the coal sample being introduced directly into conduit 52. Alternatively, the coal particles could be comminuted by crushing, grinding, or other conventional techniques to a size of about 1.5 inches or less in diameter and then introduced into a single screening apparatus as just explained. Additionally, vibrating means could also be provided for screen 50 and/or screen 54 to speed up the rate of separation and enhance the separation achieved.

Similarly, separating means 70 shown in FIG. 3 could be configurated as two conveyor belts having screens of different grid or mesh sizes to achieve the same type of double screening as is achieved in the embodiment of FIG. 2. Also, it will be recognized, that vibrating means 76 associated with separating means 70 could be deleted if desired. In view of the foregoing, it will be appreciated that other variations to the embodiments of FIGS. 2 and 3 would also be possible.

It is also important to note that not only are there many possible variations to the embodiments of the separating means shown in FIGS. 2 and 3, but also many other separating means could be used to separate the small coal particles from the larger coal particles in accordance with the present invention. Indeed, any suitable separating means known in the art whereby smaller particles are separated from larger particles could be used in accordance with the present invention. Thus, it will be understood that the embodiments of the separating means 40 and 70 shown in FIGS. 2, and 3, respectively, are given by way of illustration only, and that various other separating means may also be employed in accordance with the present invention.

C. The Method of the Present Invention

A presently preferred method of operation of the apparatus of the present invention will now be explained. A quantity of coal or other combustible material of variously sized particles is first produced. If relatively larger coal particles are present in the coal, the coal may either be comminuted to reduce the particle size to about 1.5 inches or less in diameter, or the coal particles larger than about 1.5 inches in diameter may be separated out from the remaining smaller coal particles. Next, the coal particles smaller than 0.05 inches in diameter (i.e., the fines) are separated out from the larger coal particles, thereby yielding coal particles having a diameter of about 0.05–1.5 inches.

As discussed above, under certain circumstances it may be desirable to separate out of the coal sample, all coal particles larger than about one inch in diameter and all particles smaller than about 0.1 inches in diameter, such that only those coal particles having a diameter of about 0.1–1 inches remain. In such an embodiment, separation of the larger and smaller coal particles may be achieved by the same techniques described above, i.e., comminution, particle separation, etc.

As discussed previously, separation of the coal fines from the larger coal particles may be accomplished in a variety of ways. In the operation of the embodiment of FIG. 2, a coal sample is introduced into conduit 42 through inlet 44 in the direction indicated by arrow A in FIG. 2. The coal travels downwardly into first separating chamber 48 and the smaller coal particles, e.g., those coal particles having a diameter of about 1.5 inches or less pass through screen 50 into conduit 52, while the coal particles larger than about 1.5 inches in diameter continue through conduit 42 and are removed through outlet 46 in the direction indicated by arrow B.

The coal particles having a diameter of about 1.5 inches or less continue downwardly through conduit 52 and enter second separating chamber 54. Those coal particles which are smaller than about 0.05 inches in diameter pass through screen 56 in separating chamber 54 into conduit 60, and are removed from conduit 60 in the direction shown by arrow D. The coal particles having a diameter of about 0.05 inches or greater in diameter, continue through conduit 52 and are removed from outlet 58 in the direction shown by arrow C. The coal particles having a diameter of about 0.05–1.5 inches are removed from outlet 58 and are then introduced into spreader-stoker-fired furnace 10.

In the operation of separating means 70 illustrated in FIG. 3, a coal sample is introduced onto the screen 74 of conveyor belt 72, with the conveyor traveling in the direction indicated by arrow E. The coal particles smaller than about 0.05 inches in diameter pass through screen 74 in the direction indicated by arrow G and are collected in a bin or other suitable collector (not shown). The remaining coal particles larger than about 0.05 inches in diameter continue along conveyor belt 72 in the direction indicated by arrow F which leads to spreader-stoker-fired furnace 10. By actuating vibrating means 76, passage of the smaller coal particles through screen 74 is enhanced, thereby speeding up the rate of separation. If the coal to be introduced onto conveyor belt 72 is of a particle size larger than about 1.5 inches in diameter, the coal is preferably first comminuted before introduction thereof onto conveyor belt 72.

The coal particles removed from outlet 58 in the direction of arrow C in the embodiment of FIG. 2 and the coal particles carried by conveyor belt 72 in the direction of arrow F after separation of the fines in the embodiment of FIG. 3, have a particle size of about 0.05–1.5 inches in diameter, or about 0.1–1 inches in diameter in one presently preferred embodiment. These coal particles are introduced into spreader-stoker-fired furnace 10 illustrated in FIG. 1 through coal feed port 14.

As the coal particles are introduced into coal feed port 14, they are engaged by rotating paddle wheel 16 and flung into the interior of spreader-stoker-fired furnace 10, into the suspension region. The flung coal particles then fall downwardly by the force of gravity through the interior of furnace 10, until coming to rest against grate 20. The accumulated coal particles against grate 20 thus form a burning fuel bed against grate 20.

A portion of the coal particles are combusted while suspended in the suspension region of furnace 10 before coming to rest against grate 20. Coal particles which are not combusted during this suspension phase fall to grate 20 and are combusted in the burning fuel bed on grate 20. If desired, samples of the burning fuel bed may be taken through bed sampling port 32.

Ashes and other by-products formed during combustion are dumped off of moving grate 20 and into the ash pit, typically from about 5 to about 20 hours after initial introduction of the coal particles into the furnace. An alternative to moving chain grate 20 would be a stationary chain grate which would be dumped at periodic intervals to remove the bed of accumulated ash. Both moving and stationary chain-type grates are well known in the art.

The air needed to support the combustion process is introduced into spreader-stoker-fired furnace 10 at a variety of locations. About 85% of the air introduced into furnace 10 is introduced from an air source (not shown) through blast gate 36 and into air chamber 34, through grate 20 and the burning fuel bed thereon, and into the interior of furnace 10. This underfire air is typically introduced into furnace 10 at a rate of about 15 ft/sec. The remaining 15% of the air used for combustion within furnace 10 is introduced from an air source (not shown) into the furnace through a series of overfire air ports 18*a–c* and 26*a–f*. If desired, the combustion gases rising upwardly through furnace 10 may be sampled through flue gas sampling port 28. The combustion gases finally exit furnace 10 through flue 30.

Once the fines have been removed from the coal in accordance with the present invention, the fines may be used for a variety of purposes. For example, the fines could be used in pulverized coal-fired furnaces which require much finer coal particle sizes. Additionally, the fines could be burned in a low $NO_x$ fines burner which is either independent of or part of a spreader-stoker-fired furnace system. Such low $NO_x$ fines burners are well known in the art. For example, the dual register burner manufactured by Babcock and Wilcox, Inc., New Orleans, La., would be suitable for such a purpose.

Still another use for the coal fines which are removed from the coal feed in accordance with the present invention is to use the fines in a spreader-stoker-fired furnace by placing the fines directly on the burning fuel bed, thereby burning the fines without passing them through the suspension region of the spreader-stoker-fired furnace. This could be done, for example, by introducing the fines through bed sampling port 32 in spreader-stoker-fired furnace 10 illustrated in FIG. 1, so as to introduce the fines onto the burning fuel bed adjacent grate 20 as directly as possible. In such an embodiment, even though the fines are burned within the furnace 10, burning of the fines in the suspension region of furnace 10 is avoided, thereby avoiding the higher $NO_x$ emissions experienced during combustion in the suspension region.

Alternatively, other means could be provided for introducing the fines directly onto the burning fuel bed so as to minimize the amount of time that the fines are suspended within furnace 10. Such other means might include means for mixing the fines with fly ash which is being introduced into the furnace to improve carbon burnout. In this embodiment, burning of the fines in the suspension region of furnace 10 is avoided by reducing the rate of underfire air flow through grate 20.

It wll be appreciated by those of ordinary skill in the art that the fines removal techniques of the present invention may be employed with virtually any conventional spreader-stoker-fired furnace, and that the spreader-stoker-fired furnace 10 illustrated in FIG. 1 is given by way of example only. Indeed, one of the primary advantages of the method and apparatus of the present invention is that the fines removal techniques of the present invention may be used in virtually any existing spreader-stoker-fired furnace, thereby eliminating the need to replace existing furnaces with completely new equipment.

D. An Alternative Embodiment of the Present Invention

Figure 4:
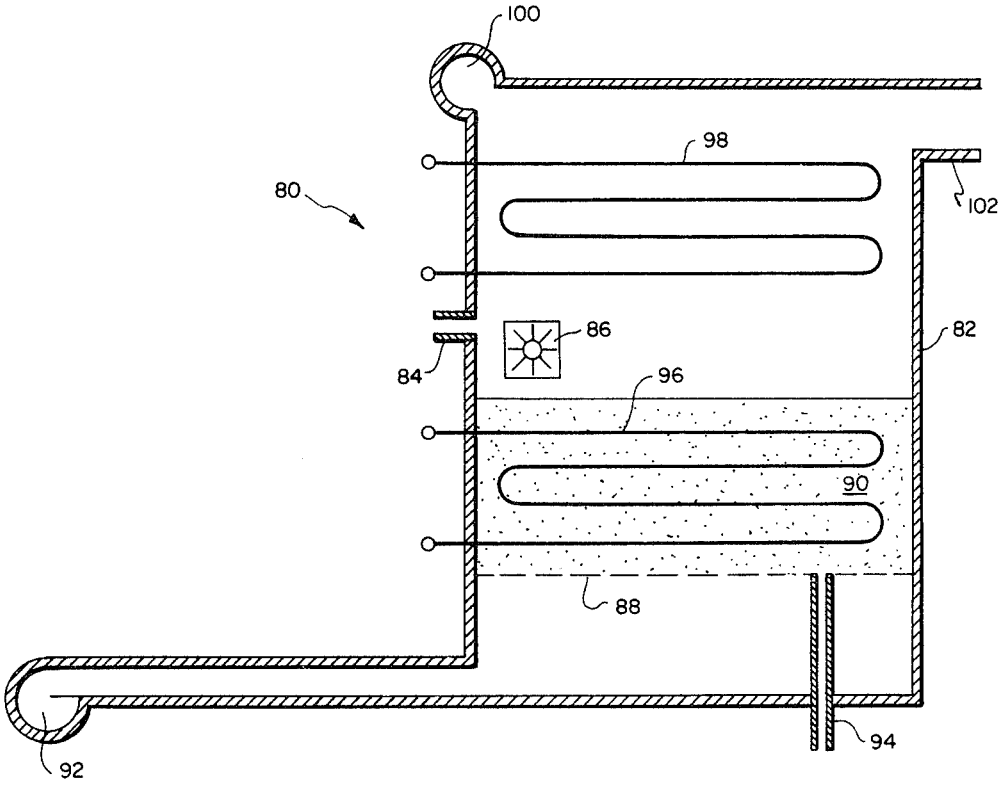
FIG. 4 illustrates a typical fluidized bed combustor which may be used in accordance with the present invention.

An alternative embodiment of the present invention involves the application of the present invention to a fluidized bed combustor. Referring particularly to FIG. 4, a presently preferred embodiment of a fluidized bed combustor is generally designated 80. The apparatus includes a housing 82 made of high temperature refractory or insulating material, similar to that for spreader-stoker-fired furnace 10 of FIG. 1.

Formed in fluidized bed combustor 80 is a coal feed port 84 for introducing coal into combustor 80. A rotating paddle wheel-type spreading mechanism 86 is mounted within combustor 80 adjacent coal feed port 84 and serves to fling the incoming coal into the interior of combustor 80. At the bottom of fluidized bed combustor 80 is a grid plate 88 with a fluidized bed 90 formed thereon. Fluidized bed 90 is maintained by an air fan 92 which supplies air through grid plate 88 and into fluidized bed 90. The area of apparatus 80 above fluidized bed 90 is the suspension region of apparatus 80, and is better known in the art as the "freeboard" region. Combustor 10 further includes a bed drain tube 94.

Mounted within fluidized bed combustor are boiler tubes 96 and 98 through which water is circulated when combustor 80 is used for the generating of steam or hot water. During the operation of combustor 80, the water within boiler tubes 96 and 98 is converted to steam or hot water as the combustor is heated by combustion of the combustible material therein. Boiler tube 96 is submerged within fluidized bed 90, while boiler tube 98 is positioned above the fluidized bed. A water drum 100 is provided for supplying water to boiler tubes 96 and 98. A flue 102 is provided at the upper end of combustor 80 to accommodate exit of the effluent gases from combustor 80.

In the operation of fluidized bed combustor 80, a quantity of coal or other combustible material of variously sized particles is first procured, and the coal particles are comminuted, if necessary, to reduce the particle size to about 1.5 inches or less in diameter, and the coal particles smaller than 0.5 inches in diameter (i.e., the fines) are separated out from the larger coal particles, in accordance with Section C above.

These coal particles are then introduced into fluidized bed combustor 80 illustrated in FIG. 4 through coal feed port 84. As the coal particles are introduced into coal feed port 84, they are engaged by rotating paddle wheel 86 and are flung into the interior of fluidized bed combustor 80, into the freeboard region. The flung coal particles then fall downwardly by the force of gravity through the freeboard region of combustor 80, until coming to rest in the fluidized bed 90, where they are combusted. The burning fluidized bed 90 is maintained by injecting air from air fan 92 through grid plate 88 and into the fluidized bed 90. The air is introduced through grid plate 82 at a rate of about 2 feet per second (ft/sec) to about 14 ft/sec so as to maintain the fluidized bed 90 above grid plate 88.

The overall vertical velocity in the fluidized bed combustor 80 is substantially faster than in the spreader-stoker-fired furnace since both large and small particles of the combustible material must be fluidized in fluidized bed 90. Additionally, sorbent particles (e.g., limestone) may be added to fluidized bed 90 so as to capture sulfur dioxide ($SO_2$) emissions.

A portion of the coal particles introduced into fluidized bed combustor 80 are combusted while suspended in the freeboard region of the combustor before coming to rest in the fluidized bed 90. Coal particles which are not combusted in the freeboard region fall into the fluidized bed 90 and are combusted. The operation of apparatus 80 of FIG. 4 is thus similar to that of apparatus 10 of FIG. 1, except that a fluidized bed rather than a fixed bed is formed within apparatus 80.

Importantly, it will be understood that this alternative embodiment of the present invention also includes means for separating out smaller coal particles or fines, i.e., coal particles which would normally combust during the suspension phase in the freeboard region of the fluidized bed combustor. Thus, the presently preferred embodiments of the present invention for accomplishing separation of the smaller particles or fines from the larger particles, as illustrated in FIGS. 2 and 3, are also used in conjunction with fluidized bed combustor 80.

Because the fines are first removed in the present invention, the present invention would significantly reduce the amount of fines carried over out of the fluidized bed 90 and into the effluent gas exiting flue 102. Further, removal of the fines also serves to decrease the amount of $NO_x$ produced in the freeboard region of fluidized bed combustor 80. Additionally, removal of the fines would serve to reduce the amount of sulfur dioxide ($SO_2$) emissions since removal of the fines would minimize the amount of sulfur dioxide evolved in the freeboard region, and the sorbent in the fluidized bed 90 would act to trap sulfur dioxide evolved within the fluidized bed 90.

It will be further understood that the fines removal techniques of the present invention may be employed with other conventional fluidized bed combustors, and that the fluidized bed combustor 80 illustrated in FIG. 4 is given by way of example only. Moreover, it will be appreciated that the fines removal techniques of the present invention may be applied to any furnace or combustion apparatus wherein the combustible material passes through a suspension phase, and is not limited to the applications of the spreader-stroker-fired furnace or the fluidized bed combustor disclosed herein.

Thus, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for reducing $NO_x$ and particulate pollutant emissions from a furnace having a suspension region, the method comprising the steps of:

obtaining a combustible material of variously sized particles;

separating smaller particles of the combustible material, which would normally combust while suspended within the suspension region of the furnace, from larger particles of the combustible material, thereby minimizing the formation of $NO_x$ and particulate emissions during combustion in the suspension region of the furnace;

introducing the larger particles of combustible material, from which smaller particles of combustible material have been separated, into the suspension region of the furnace; and combusting the combustible material within the furnace to produce heat.

2. A method as defined in claim 1 wherein the furnace is a spreader-stroker-fired furnace.

3. A method as defined in claim 1 wherein the furnace is a fluidized bed combustor.

4. A method as defined in claim 1 wherein the combustible material comprises coal.

5. A method as defined in claim 4 wherein the obtained coal particles have a diameter of about 1.5 inches or less.

6. A method as defined in claim 4 further comprising the step of comminuting the obtained coal particles to a particle size of about 1.5 inches or less before the separating step.

7. A method as defined in claim 4 wherein the obtained coal particles have a diameter of about 1 inch or less.

8. A method as defined in claim 4 wherein the separating step comprises separating coal particles smaller than about 0.05 inches in diameter from larger coal particles.

9. A method as defined in claim 4 wherein the separating step comprises separating coal particles smaller than about 0.1 inches in diameter from larger coal particles.

10. A method as defined in claim 4 further comprising the step of passing the obtained coal particles through a first screen so as to separate out coal particles larger than about 1.5 inches in diameter and wherein the separating step comprises passing the remaining coal particles having a diameter of about 1.5 inches or less through a second screen so as to separate out coal particles smaller than about 0.05 inches in diameter.

11. A method as defined in claim 1 wherein the separating step comprises passing the particles of combustible material through a screen so as to separate out the smaller particles which would normally combust in the suspension region of the furnace.

12. A method as defined in claim 11 wherein the screen comprises a vibrating screen mounted to a conveyor leading to the furnace.

13. A method as defined in claim 1 wherein the combustible material comprises wood.

14. A method as defined in claim 1 wherein the combustible material comprises peat.

15. A method as defined in claim 1 wherein the combustible material comprises char.

16. A method as defined in claim 1 wherein the combustible material comprises municipal wastes.

17. A method as defined in claim 1 wherein the combustible material comprises industrial wastes.

18. A method as defined in claim 1 wherein the combustible material comprises agricultural wastes.

19. A method for reducing $NO_x$ and particulate pollutant emissions from a spreader-stoker-fired furnace, the method comprising the steps of:

obtaining coal having a particle size of about 1.5 inches or less in diameter;

passing coal particles through a screen so as to separate out coal particles smaller than about 0.05 inches in diameter from larger coal particles, thereby minimizing the formation of $NO_x$ and particulate pollutant emissions during combustion in a suspension region of the spreader-stoker-fired furnace;

introducing the larger coal particles, from which coal particles smaller than about 0.05 inches in diameter have been separated, into the suspension region of the spreader-stoker-fired furnace; and combusting the coal particles within the spreader-stoker-fired furnace to produce heat.

20. A method as defined in claim 19 wherein the obtained coal particles have a diameter of about 1 inch or less.

21. A method as defined in claim 19 wherein the passing step comprises passing the coal particles through a screen so as to separate out coal particles smaller than about 0.1 inches in diameter.

22. A method as defined in claim 19 wherein the screen comprises a vibrating screen mounted to a conveyor leading to the spreader-stoker-fired furnace.

23. A method as defined in claim 19 wherein the coal particles having a diameter of about 1.5 inches or less are obtained by passing coal particles of various particle sizes through a screen so as to separate out coal particles having a diameter greater than about 1.5 inches.

24. A method for reducing $NO_x$ and particulate pollutant emissions from a spreader-stoker-fired furnace, the method comprising the steps of:

obtaining coal having a particle size of about 1 inch or less in diameter;

passing the coal particles through a vibrating screen so as to separate out coal particles smaller than about 0.1 inches in diameter from larger coal particles, thereby minimizing the formation of $NO_x$ and particulate pollutant emissions during combustion in a suspension region of the spreader-stoker-fired furnace;

introducing the larger coal particles, from which coal particles smaller than about 0.1 inches in diameter have been separated, into the suspension region of the spreader-stoker-fired furnace; and combusting the larger coal particles within the spreader-stoker-fired furnace to produce heat.

25. An apparatus for producing heat from a combustible material with reduced $NO_x$ and particulate pollutant emissions, comprising:

a furnace having a suspension region;

means for obtaining a combustible material of variously sized particles;

means for separating out smaller particles of combustible material, which would normally combust while suspended within the suspension region of the furnace, from larger particles of combustible material, thereby minimizing the formation of $NO_x$ and particulate pollutant emissions during combustion in the suspension region of the furnace; and means for introducing the larger particles of combustible material, from which smaller particles of combustible material have been separated, into the suspension region of the furnace.

26. An apparatus as defined in claim 25 wherein the furnace is a spreader-stoker-fired furnace.

27. An apparatus as defined in claim 25 wherein the furnace is a fluidized bed combustor.

28. An apparatus as defined in claim 25 wherein the combustible material comprises coal.

29. An apparatus as defined in claim 30 wherein the obtained coal has a particle size of about 1.5 inches or less in diameter.

30. An apparatus as defined in claim 30 wherein the separating means comprises means for separating out coal particles smaller than about 0.05 inches in diameter.

31. An apparatus as defined in claim 30 wherein the obtained coal has a particle size of about 1 inch or less in diameter and wherein the separating means comprises means for separating out coal particles smaller than about 0.1 inches in diameter.

32. An apparatus as defined in claim 27 wherein the combustible material comprises wood.

33. An apparatus as defined in claim 27 wherein the separating means comprises a screen.

34. An apparatus as defined in claim 35 further comprising means for vibrating the screen.

35. An apparatus for producing heat from coal with reduced $NO_x$ and particulate pollutant emissions, comprising:

a spreader-stoker-fired furnace;

means for obtaining coal in a particle size of about 1 inch or less in diameter;

vibrating screen means for separating out coal particles smaller than about 0.1 inches in diameter, thereby leaving coal particles between about 0.1 inches and about 1 inch in diameter, thereby minimizing the formation of $NO_x$ and particulate pollutant emissions during combustion in a suspension region of the spreader-stoker-fired furnace; and means for introducing the coal particles between about 0.1 inches and about 1 inch in diameter, from which coal particles smaller than about 0.1 inches in diameter have been separated, into the suspension region of the spreader-stoker-fired furnace.

36. A method for reducing pollutant emissions from a furnace having a suspension region, the method comprising the steps of:

obtaining a combustible material of variously sized particles;

separating smaller particles of the combustible material, which would normally combust while suspended within the suspension region of the furnace, from larger particles of the combustible material;

introducing the larger particles of combustible material into the furnace;

combusting the larger particles of combustible material within the furnace to produce heat; and placing the smaller separated particles of combustible material directly onto a burning fuel bed within the furnace so as to combust the smaller separated particles of combustible material in the burning fuel bed.

37. A method for reducing pollutant emissions from a spreader-stoker-fired furnace, the method comprising the steps of:

obtaining coal having a particle size of about 1.5 inches or less in diameter;

passing coal particles through a screen so as to separate out coal particles smaller than about 0.05 inches in diameter from larger coal particles;

introducing the larger coal particles into the spreader-stoker-fired furnace;

combusting the larger coal particles within the spreader-stoker-fired furnace to produce heat; and placing the separated coal particles smaller than about 0.05 inches in diameter directly onto a burning fuel bed within the spreader-stoker-fired furnace so as to combust the separated coal particles.

38. An apparatus for producing heat from a combustible material with reduced pollutant emissions, comprising:

a furnace having a suspension region;

means for obtaining a combustible material of variously sized particles;

means for separating out smaller particles of combustible material, which would normally combust while suspended within the suspension region of the furnace, from larger particles of combustible material;

means for introducing the larger particles of combustible material into the furnace; and means for introducing the smaller separated particles of combustible material directly onto a burning fuel bed within the furnace.

* * * * *

UNITED STATES PATENT AND TRADEMARK OFFICE

CERTIFICATE OF CORRECTION

PATENT NO. : 4,485,747

DATED : December 4, 1984

INVENTOR(S) : David W. Pershing et al.

It is certified that error appears in the above—identified patent and that said Letters Patent is hereby corrected as shown below:

Column 1, line 57, "wide-spread" should be --widespread--
Column 2, line 60, "directly" should be preceded by --be--
Column 3, line 33, "wide-spread" should be --widespread--
Column 6, line 7, "system" should be --stream--
Column 6, line 19, "particles" should be --particle--

Signed and Sealed this

*Ninth* Day of *July 1985*

[SEAL]

*Attest:*

DONALD J. QUIGG

*Attesting Officer* *Acting Commissioner of Patents and Trademarks*